US008294012B1

(12) United States Patent
Garrick

(10) Patent No.: US 8,294,012 B1
(45) Date of Patent: Oct. 23, 2012

(54) METHOD AND APPARATUS FOR ADJUSTING NUT OF STRINGED INSTRUMENT

(76) Inventor: Walter Neil Garrick, Thomasville, AL (US)

( * ) Notice: Subject to any disclaimer, the term of this patent is extended or adjusted under 35 U.S.C. 154(b) by 218 days.

(21) Appl. No.: 12/924,005

(22) Filed: Sep. 17, 2010

Related U.S. Application Data

(63) Continuation-in-part of application No. 12/661,732, filed on Mar. 23, 2010, now abandoned.

(60) Provisional application No. 61/210,695, filed on Mar. 23, 2009.

(51) Int. Cl.
*G10D 3/06* (2006.01)

(52) U.S. Cl. ..... 84/314 N

(58) Field of Classification Search ..... 84/314 N
See application file for complete search history.

(56) References Cited

U.S. PATENT DOCUMENTS

| | | | |
|---|---|---|---|
| 2,959,085 | A | 11/1960 | Porter |
| 3,599,524 | A | 8/1971 | Jones |
| 3,605,545 | A | 9/1971 | Rendell |
| 4,304,163 | A | 12/1981 | Siminoff |
| 6,706,957 | B1 | 3/2004 | Merkel |
| 2006/0101980 | A1 | 5/2006 | Jones |
| 2010/0005944 | A1 | 1/2010 | Eliasson et al. |

*Primary Examiner* — Jeffrey Donels
(74) *Attorney, Agent, or Firm* — George L Williamson

(57) ABSTRACT

Method and apparatus for an elevation tray that quickly and easily adjusts the nut of a stringed musical instrument by containing, elevating, and lowering a traditionally fixed nut. The elevation tray attaches and detaches in the same manner, location and position as the traditional stationary nut blank between the headstock and fingerboard of the instrument. The elevation tray comprises a first and second side along with an interconnecting channel which contains a lift plate which contacts and adjusts the nut. A threaded screw passes through a cap and a bushing disposed in each side of the elevation tray to a mating threaded hole on each end of the lift plate so that the lift plate and the nut are moved up or down in response to the screw being turned clockwise or counterclockwise.

16 Claims, 3 Drawing Sheets

METHOD AND APPARATUS FOR ADJUSTING NUT OF STRINGED INSTRUMENT

RELATED APPLICATIONS

This application is a Continuation-in-Part of U.S. patent application Ser. No. 12/661,732 filed on Mar. 23, 2010 now abandoned which claimed benefit of U.S. Provisional Patent Application Ser. No. 61/210,695 filed Mar. 23, 2009.

BACKGROUND OF THE INVENTION

1. Field of the Invention

The present invention relates generally to stringed instruments and, more particularly, is concerned with a method and apparatus for adjusting the nut of a stringed instrument.

2. Description of the Prior Art

Adjustable nuts and bridges have been described in the prior art, however, none of the prior art devices disclose the unique features of the present invention.

In U.S. Patent Application Publication No. 2006/0101980 dated May 18, 2006, Jones disclosed a head assembly for stringed instruments and method for manufacturing stringed instruments. In U.S. Patent Application Publication No. 2010/0005944 dated Jan. 14, 2010, Eliasson, et al., disclosed a compensated adjustable nut for a stringed instrument. In U.S. Pat. No. 3,605,545 dated Sep. 20, 1971, Rendell disclosed an adjustable bridge for stringed musical instruments. In U.S. Pat. No. 4,304,163 dated Dec. 8, 1981, Siminoff disclosed an adjustable nut for stringed musical instruments. In U.S. Pat. No. 3,599,524 dated Aug. 17, 1971, Jones disclosed a nut mount for stringed instrument fingerboards. In U.S. Pat. No. 2,959,085, dated Nov. 8, 1960, Porter disclosed an adjustable nut for fretted stringed musical instruments. In U.S. Pat. No. 6,706,957 dated Mar. 16, 2004 Merkel disclosed an intonation system for fretted instruments.

While these adjustable nuts and bridges may be suitable for the purposes for which they were designed, they would not be suitable for the purposes of the present invention as hereinafter described.

SUMMARY OF THE PRESENT INVENTION

The present invention discloses an elevation tray that quickly and easily adjusts the nut of a stringed musical instrument by containing, elevating, and lowering a traditionally fixed nut. The elevation tray attaches and detaches in the same manner, location and position as the traditional stationary nut between the headstock and fingerboard of the instrument. The elevation tray comprises a first and second side along with a connecting channel which contains a lift plate which contacts and adjusts the traditional nut. A threaded screw passes through a cap and a bushing disposed in each side of the elevation tray to a mating threaded hole on each end of the lift plate so that the lift plate and the traditional nut are moved up or down in response to the screw being turned clockwise or counterclockwise.

In the past many inventions have been concerned with replacing the traditional nut, with adjustable nuts, assembled from metal that provide metal string supports which the strings are individually suspended there upon and individually adjusted one string at a time thereby replacing the traditional nut designed to be used with a particular fingerboard radius on a stringed instrument.

An object of the present invention is to provide a method with apparatus for preserving the traditional nut design, nut radius, nut material and provide user friendly elevation adjustments of the traditional nut designed to be used with a particular fingerboard radius on a stringed instrument.

A further object of the present invention is to provide a method with apparatus that will allow the pitch of all the strings of a stringed instrument to be hand adjusted by the user in an easy and convenient manner, including while the instrument is being played by the user.

A further object of the present invention is to provide a method and apparatus that allows the user the ability to change the string action on a stringed instrument from low, medium to high for playing lead, rhythm and slide or vise versa to be adjusted by the user's hand in an easy and convenient manner, including while the instrument is being played by the user.

A further object of the present invention is to allow all of the strings of the stringed instrument to be simultaneously lowered or raised a semitone above or below the fundamental tuned frequency of a stringed musical instrument in a convenient and easy manner, including while the instrument is being played by the user.

A further object of the present invention is to provide a hand adjustable tray for stringed instruments which can be easily used by the user of the instrument.

A further object of the present invention is to provide a hand adjustable tray for a stringed instrument which can be relatively easily and cheaply manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
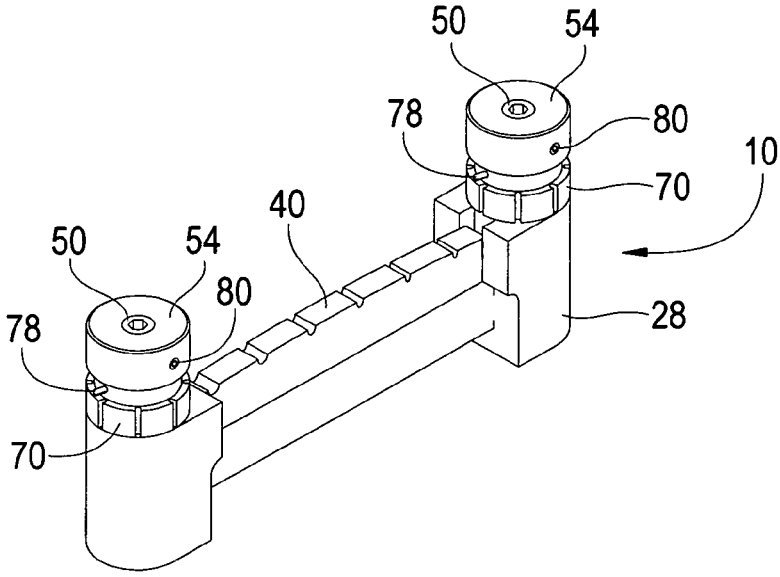
FIG. 1 is a perspective view of the present invention.

With regard to reference numerals used, the following numbering is used throughout the drawings.

| | |
|---|---|
| 10 | present invention |
| 12 | traditional stringed instruments or instrument |
| 14 | instrument strings or string |
| 16 | traditional fingerboard or fingerboard |

-continued

| | |
|---|---|
| 18 | frets |
| 20 | fret markers |
| 22 | neck |
| 24 | headstock |
| 26 | tuning keys |
| 28 | elevation tray |
| 30 | cavity top |
| 32 | cavity bottom |
| 34 | left side edge |
| 36 | right side edge |
| 38 | tray channel |
| 40 | traditional nut |
| 42 | lift plates or lift plate |
| 44 | left lift plate |
| 46 | right lift plate |
| 48 | tension spring |
| 50 | adjustment screws or adjustment screw |
| 52 | cavity |
| 54 | adjustable cap |
| 55 | cap aperture |
| 56 | threaded portion |
| 58 | string slot |
| 60 | traditional nut slot |
| 62 | adhesive or glue |
| 63 | channel |
| 64 | channel walls or wall |
| 66 | channel floor |
| 68 | bushing base |
| 69 | bushing aperture |
| 70 | stationary bushing |
| 72 | threaded hole or threaded holes |
| 74 | inside cavity bottom |
| 76 | index marks |
| 78 | index pointer |
| 80 | set screws or set screw |
| 82 | socket head |
| 84 | truss rod |
| 86 | bottom of the elevation tray |
| 88 | wall |
| 90 | cut-through |

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of a complete scope of the invention the reader is directed to the appended claims. FIGS. 1 through 4 illustrate the present invention wherein a method and apparatus for adjusting the nut of a string instrument is disclosed.

Figure 2:
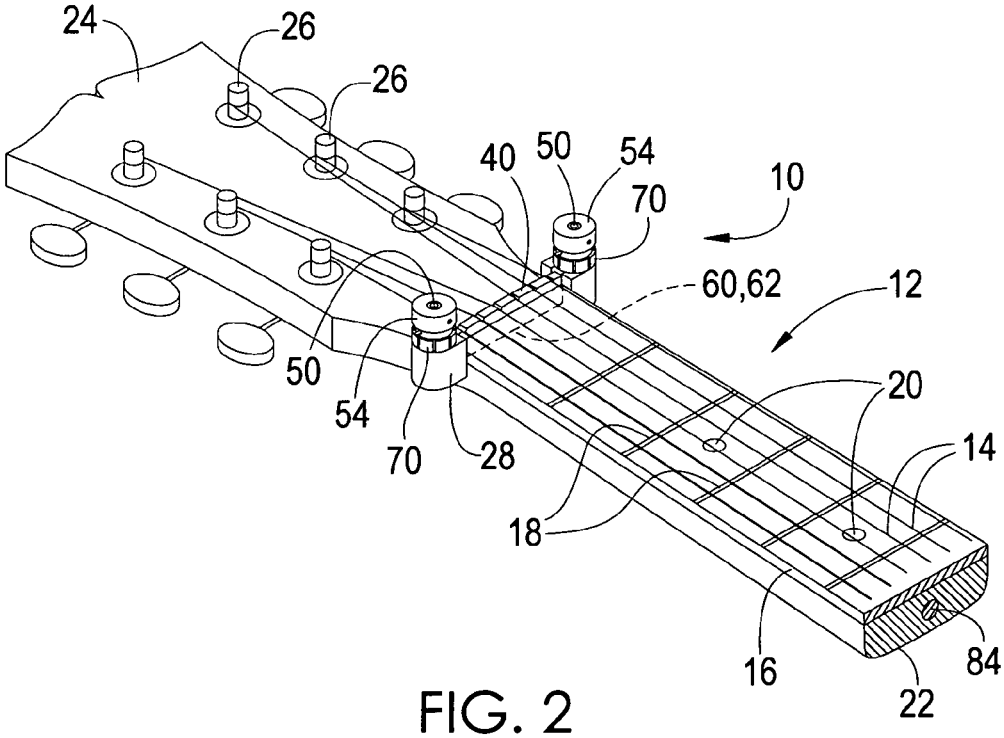
FIG. 2 is an environmental view of the present invention.

Referring to FIGS. 1-4, therein is shown the present invention 10 constructed to increase intonation and playability of a traditional stringed musical instrument 12 (see FIG. 2) having multiple strings 14 on a fingerboard 16 with multiple frets 18 and fret markers 20 on a neck 22 with a headstock 24 having multiple tuning keys (machine heads) 26 thereon. The elevation tray 28 which serves as a receptacle (see FIG. 3A) for the nut 40 has a cavity top 30 and cavity bottom 32 and a left side edge 34 and right side edge 36 that have a depth, width and height that form a tray channel 38 extending between the left and right sides being complimentarily sized and shaped to serve as a receptacle for and to contain the nut 40 and hold the nut blank securely in place. The first and second side portions 34, 36 of the elevation tray 28 have a cut-through 90 therein and the cut-throughs 90 receives at least a short portion of the first and second end portions of the nut 40 therein. The elevation tray 28 is mounted as shown in FIG. 2 and attaches in the nut slot 60 of the neck 22 of the instrument 12 in the exact location and position as a traditional nut 40 glued 62 in the exact place once occupied by the original traditional nut blank.

Figure 4:
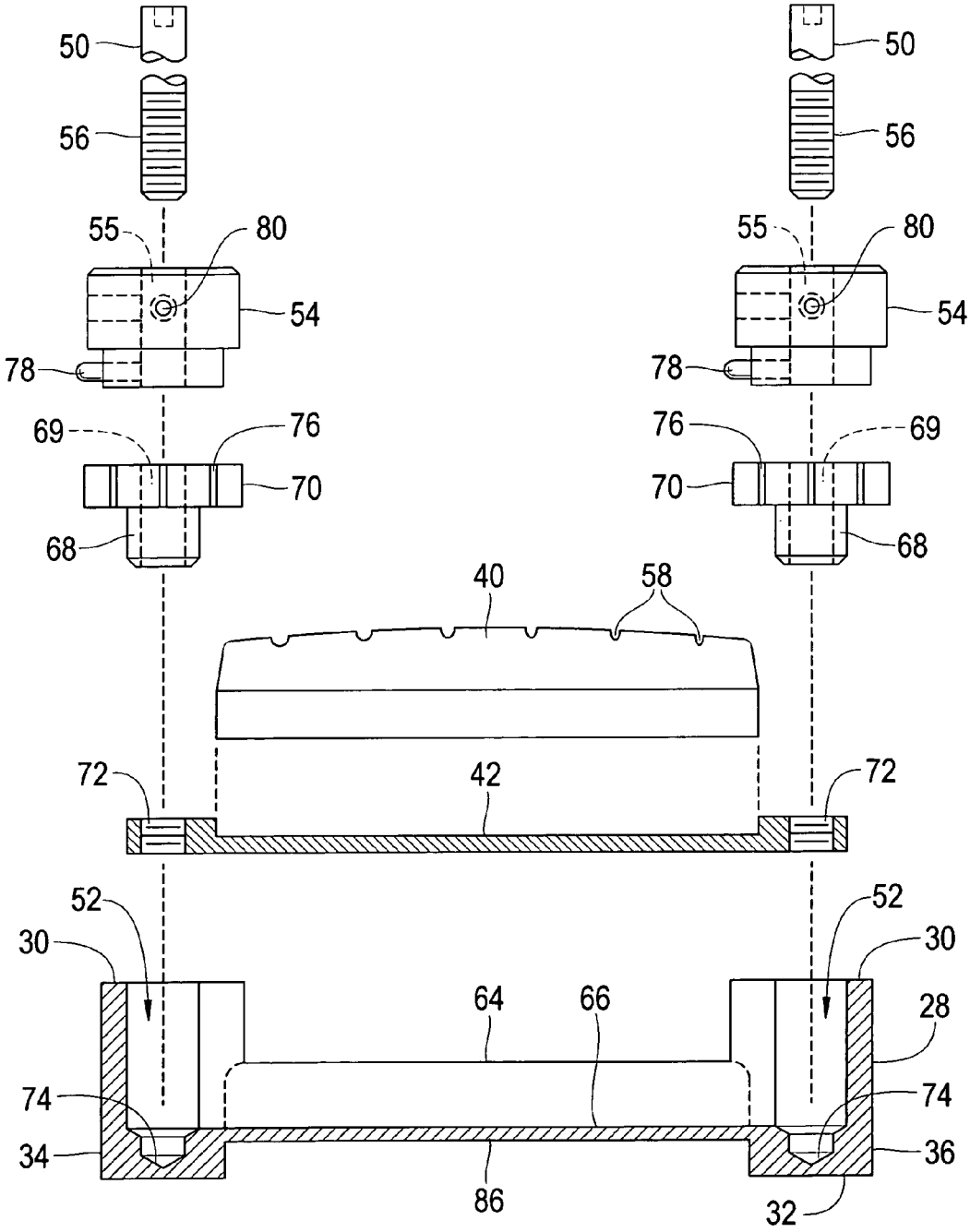
FIG. 4 is an exploded partial cross-sectional view of the present invention taken from FIG. 3A as indicated.

The bottom 86 of the elevation tray 28 shown in FIG. 4 is designed with a first left side edge 34 and second right side edge 36 that fits securely (see FIG. 2) to the neck 22 of the musical instrument 12 so the elevation tray 28 is centrally disposed relative to the fingerboard 16 at all times.

Figures 3A, 3B:
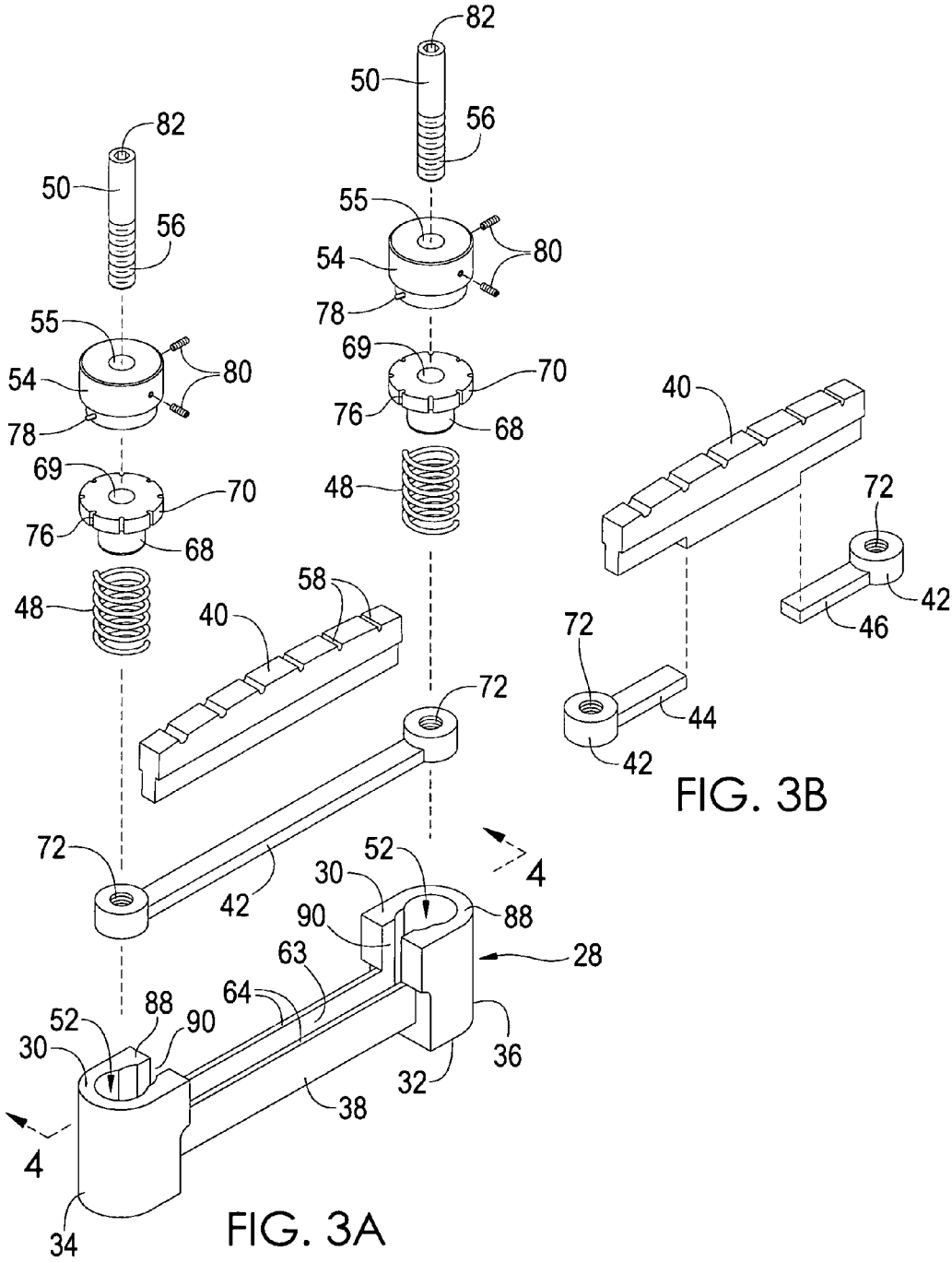
FIG. 3A is an exploded perspective view of the present invention.
FIG. 3B is an exploded perspective view of portions of an alternative embodiment of the present invention.

The lift plate 42 shown in FIG. 4 is constructed to elevate the traditional nut 40 (see FIG. 2) to a desired height for optimal distance adjustments between the strings 14 and the frets 18 of a traditional fingerboard 16 on a musical instrument 12. The sides of the lift plate 42 are complementarily sized and shaped as shown in FIG. 4 to fit the angled sides of a traditional nut 40 blank. In addition, the lift plate 42 may comprise one (see FIG. 3A) or two (see FIG. 3B) pieces that fit underneath the traditional nut 40 blank to support, raise and lower the nut. The depth of the tray channel 38 shown in FIG. 3A is sufficient to allow for height adjustment of the lift plate 42 while maintaining constant pressure on the channel walls 64 of channel 63 and a constant downward pressure on the channel floor 66 shown in FIG. 4. The two piece lift plates 42 having divided extensions (see FIG. 3B) which are separated making both left lift plate 44 and right lift plate 46 two completely separate units that operate independently of each other are used with the traditional or split nut. The lift plate 42 shown in FIG. 3A is one piece and operates only with a traditional nut 40 as one unit. The lift plate 42 fits into the tray channel 38 securely and will not rotate front to back or from side to side for smooth accurate intonation. This forms a custom fit that holds the lift plate 42 in position and prevents any unwanted movement. FIG. 3A also shows the walls 88 which define the side portions 34, 36 of the elevation tray 38 and pair of cut-throughs or openings 90 in the walls which are contiguous with the channel 63.

The tension spring 48 (see FIG. 3A) is optional and may or may not be used to reinforce the lift plate 42 when instrument string 14 tension is decreased, increased or completely removed from the instrument 12. The optional tension spring 48 surrounds the bottom threaded portion 56 of each adjustment screw 50 and fits flush against the bottom surface of each bushing base 68 of each stationary bushing 70 in each hollow cavity 52 located at either end/side 34, 36 of the elevation tray 28. When used the tension spring 48 maintains an equal amount of upward pressure pushing against bottom of the bushing base 68 while maintaining an equal amount of downward pressure pushing in the opposite direction against the top of the lift plate 42. Some common reasons for decreasing, increasing or removing instrument string 14 tension from a stringed instrument 12 include changing the traditional nut 40 blank, strings or in the event the instrument is being retuned to a lower or higher pitch.

The adjustable cap 54 and stationary bushing 70 (see FIG. 3A) can be removed from the elevation tray 28 in order to replace any worn parts. The adjustable cap 54 has an unthreaded smooth cap aperture 55 therein through which the adjustment screw 50 which has smooth upper sides and a bottom threaded portion 56 extends down through and continues down through the smooth unthreaded bushing aperture 69 and optional tension spring 48 and screws into the mating threaded hole 72 at each first and second end of the lift plate 42 disposed in each hollow cavity 52 located at each end/side 34, 36 of the elevation tray 28.

The adjustment screws 50 are effectively long, so that the top of each adjustment screw fits flush inside the top of each adjustable cap 54 and the bottom of each adjustment screw fits flush (see FIG. 4) against the smooth unthreaded inside cavity bottom 74 of each cavity 52 located at each end/side 34, 36 of the elevation tray 28. The apertures 55, 69, 72 and cavity 52 are co-aligned and share a common central axis so they are substantially centrally disposed in each cavity of sides 34, 36 of the elevation tray 28.

The stationary bushing 70 has a plurality of incremental index marks 76 disposed circumferentially shown in FIG. 3A about the stationary bushing so that the index pointer 78 cooperates with the index marks 76 so that the traditional nut 40 can be precisely and incrementally adjusted by the user by referencing the index pointer 78 to the index marks 76. The index pointer 78 and the index marks 76 are coated with luminous paint, so the index pointer and the index marks glow in the dark allowing the user the ability to make precise elevation adjustments in low light conditions sometimes associated with playing a stringed instrument 12.

At least one set screw 80 is horizontally disposed in the adjustable cap 54 so as to securely lock adjustment screw 50 to adjustable cap 54. The adjustable cap 54 can be adjusted by hand or the adjustment screw 50 also has a socket head 82 (see FIG. 3A) in its top end so that it can be turned with an allen wrench or a similar tool.

Stationary bushing 70 is pressed to fit into the cavity 52 located in the sides 34, 36 of elevation tray 28 so as to prevent rotation of the bushing. Further, downward pressure from instrument string 14 tension reinforces the traditional nut 40, transfers downward pressure to the lift plate 42 and adjustment screw 50 internally inside the elevation tray 28. Turning the adjustable cap 54 by hand or turning the adjustment screw 50 by tool in a clockwise rotation will cause the lift plate 42 to ride up the threaded portion 56 of the adjustment screw incrementally lifting the lift plate.

Turning the adjustable cap 54 by hand or turning the adjustment screw 50 by tool in a counter clockwise rotation will have the opposite effect and the lift plate 42 will ride down the threaded portion 56 of the adjustment screw and the lift plate will move in a downward direction.

The traditional nut 40 rests on the top of the lift plate 42 into the hollow bottom of the tray channel 38 and is further held in place by the channel walls 64 on either side of the tray. The traditional nut 40 rests (see FIG. 4) securely on the lift plate 42 cross-member or extension that fits adjacent to both sides of the traditional nut 40 and underneath the bottom of the nut blank. This contoured fit prevents any horizontal, forward or backward rotation of the traditional nut 40 and will allow one to file string slots 58 in the nut blank if needed without removing the nut blank from the tray channel 38. The tray channel 38 holds the traditional nut 40 securely in the elevation tray 28 and allows (see FIG. 2) one to make precise distance adjustments between the instrument's strings 14 and frets 18 (if any), located on the traditional fingerboard 16 of the musical instrument 12 consequently increasing instrument intonation and playability.

The accuracy of the elevation tray 28 depends on the adjustment screw 50 (see FIG. 3A) thread ratio per unit of length. The elevation tray 28 has an adjustment screw 50 with a thread ratio of 32 threads per inch allowing 0.03125 of an inch for each 360 degree adjustment screw rotation. The adjustable cap 54 is locked in rotational unison with the adjustment screw 50 by the set screws 80 so when the adjustment screw rotates 360 degrees the adjustable cap rotates 360 degrees. The adjustable cap 54 has an index pointer 78 (see FIG. 3A) and the stationary bushing 70 has 8 equally spaced index marks 76 that divide the 360 degree rotational distance traveled by 1 complete turn of the adjustable cap into 8 equally spaced measurements. Divide the rotation distance traveled 0.03125 or one complete 360 degree turn of the adjustable cap 54 by 8 to determine the distance between each of the 8 index marks 76 located on the stationary bushing 70. A rotational distance of 0.03125 divided by 8 equals 0.00390625 or approximately 0.004 of an inch between each index mark 76. The user can easily (see FIG. 4) make 4 additional adjustments between each index mark 76 divide 0.004 by 4 and the elevation tray 28 has a hand adjustable accuracy of approximately 0.001 of an inch.

Once the old stationary traditional nut 40 has been removed (see FIG. 2) from the instrument 12 and the empty traditional nut slot 60 where the old traditional nut once occupied is cleaned of any residual glue 62, the new adjustable elevation tray 28 is ready to be glued into place. Instrument glue or adhesive 62 is evenly applied underneath the bottom of the tray 86 shown in FIG. 4 and evenly applied in the same manner to the empty nut slot 60 (see FIG. 2) between the headstock 24 and the fingerboard 16 of the instrument 12 and the elevation tray 28 is immediately glued in place at the exact location and position in the empty nut slot once occupied by the old stationary traditional nut 40. After the elevation tray 28 has been properly attached in the traditional nut slot 60, apply a small amount of downward pressure with your hand and hold the elevation tray very still to properly seat the tray. While the elevation tray 28 is being held securely in place, carefully remove any excess glue 62 from the instrument 12 with a damp cloth. Wait about five minutes then slowly remove your hand pressure and gently remove your hand from the elevation tray 28. Allow the glue 62 to completely cure before moving the instrument 12 or having any more contact with the elevation tray 28. After the glue 62 has completely cured, insert the new traditional nut 40 blank into the elevation tray 28.

Unlike the old, traditional nut blank, the new traditional nut 40 blank fits freely and may be inserted or removed from the elevation tray 28 by hand. Next, file string slots 58 shown in FIG. 3A in the nut blank if needed, and restring the instrument 12 (see FIG. 2) leaving string 14 tension loose on the instrument prior to making any elevation adjustments to the traditional nut 40. As the traditional nut 40 elevates, instrument string 14 tension will increase. Now you can easily elevate the traditional nut 40 by hand to the desired height best suited for your playing techniques without adding unnecessary string 14 tension to the newly seated elevation tray 28. Once you have achieved the desired string 14 height best suited for your personal playing characteristics you can easily retune and play the instrument 12 with precise intonation.

The following general background information (see FIG. 2) makes reference to past inventions and how they differ from the present invention 10. An instrument string 14 that has a constant density, tension and length tuned to concert pitch (440 Hz) will produce (880 Hz) if you reduce ½ of the original string's length. If you reduce the instrument string 14 length by ½ the same string will produce a frequency one octave higher. String frequency is inversely proportional to the length of the instrument string 14, so if you divide the string length by two you multiply the string frequency by two. This is the basic mathematical principle reasoned for horizontal string length adjustments with respect to many past inventions; however the elevation tray 28 utilizes the vertical string 14 plane because a quality built stringed musical instrument 12 applies the above mentioned mathematical principle in the construction of the musical scale length of the instrument. If you measure the string length from where the instrument strings 14 contact the traditional nut 40 to the $12^{th}$ fret 18 location and from the $12^{th}$ fret location to where the strings contact the saddle the two measurements will be equal, minus several hundreds of an inch to allow for neck 22 relief and machine tolerances. There is little reason if any to adjust horizontal string 14 length on a quality built musical instrument 12. The small difference between the $12^{th}$ fret location and the point where the strings 14 contact the saddle is purposely created to allow for neck 22 relief to compensate for the pulling force transferred to the neck and headstock 24 of the instrument 12 after the strings are tuned. Any small difference left in the scale length (if any) is often compensated for on a quality instrument 12 by adjusting the truss rod 84 in the neck 22 of the instrument.

The elevation tray 28 can change the pitch or frequency of a vibrating instrument string 14 by varying the instrument string tension. If you increase the tension of a string 14 you increase the pitch of the string and if you decrease the string's tension you decrease the pitch of the string. Tuning keys (machine heads) 26 located on the headstock 24 of most, of the traditional instruments 12 are used to vary individual instrument string 14 tension (pulling force) to tune the musical instrument. The mathematical principle utilized by this style of mechanical tuner states the frequency of an instrument string 14 (speed of wave propagation) is proportional to the square root of the pulling force (tension) of the string. The current typical method of traditional instrument 12 tuning is to increase or decrease individual instrument string 14 tension in a singular method (one string at a time) until a musician's predetermined target pitch is reached, for example concert pitch (440 Hz). Once the musician's target pitch has been achieved the elevation tray 28 (inserted mechanical tuner) is designed to make use of the same mathematical operating principle to increase or decrease the pulling force (tension) of all the instrument strings 14 in unison (at the same time) while maintaining vertical radial uniformity across the musical instrument's 12 entire intonation system.

With the stringed instrument 12 tuned to concert pitch (440 Hz) the musician uses the elevation tray 28 (inserted mechanical tuner) to decrease the instrument string 14 tension (by lowering the stationary nut) in a uniform vertical radial string plane that simultaneously tunes the instrument's pitch down and lowers the instrument's string action. In reverse order with the stringed instrument 12 tuned to concert pitch (440 Hz) the musician uses the elevation tray 28 (inserted mechanical tuner) to increase the instrument string 14 tension (by elevating the stationary nut) up in a uniform vertical radial string plane that tunes the instrument's pitch up and simultaneously raises the instrument's string action.

One main structural design objective was to construct the present invention 10 so that it could change the traditional instrument string 14 action from low, medium to high for lead, rhythm or slide playing respectively and maintain the same fundamental frequency. The elevation tray 28 utilizes the vertical operating string 14 plane located between the top of the frets 18 of the traditional fingerboard 16 to the bottom of the vibrating strings working in combination with the individual tuning keys (machine heads) 26 located on the headstock 24 of the traditional musical instrument 12 to accomplish this objective. The musician uses the tuning keys (machine heads) 26 located on the headstock 24 of the stringed musical instrument 12 to loosen the string tension (stretching force) exerted in the horizontal string plane across the traditional nut 40 and then uses the elevation tray 28 to readjust the stationary nut position up or down to set a new vertical operating string plane (low, medium or high action) between the top of the frets 18 of the traditional fingerboard 16 to the bottom of the vibrating strings 14. The musician then retunes the instrument using the tuning keys (machine heads) 26 located on the headstock 24 of the traditional instrument 12 back to the same fundamental frequency for example concert pitch (440 Hz).

The elevation tray 28 takes advantage of interrelated physical laws in order for these mechanical processes to work homogenously. The instrument string 14 frequency is inversely proportional to the square root of the string's (density) linear mass. Simply put if one changes the density of the instrument string 14 you change the string's (timbre) tone quality. One can't change the string's density, but you can change any string or an entire set of instrument strings 14 on a traditional musical instrument 12 from a heavier density to a lesser density, say from a heavier 12 gauge set of strings to a set of 9 gauge strings or vise versa. If one changes the construction material used to build and play the stringed musical instrument 12 you change the density and sound quality of the instrument. The above associated physical law explains the need for the elevation tray 28 with the inherent ability to preserve the design, density and pitch characteristics of the original material used in constructing and playing a traditional musical instrument 12.

The traditional nut 40 has a density and because of this fact a traditional nut made of corian will have a different timbre (resonate tone) than a traditional nut made of vintage bone, polymer, graphite, pearl, ivory, slate etc. The traditional nut 40 also has a radius that is designed to specifications dictated by the radial design of the traditional fingerboard 16. The traditional nut 40 holds the musical instrument strings 14 in a fixed vertical radial configuration in a constant perpendicular relationship to the fingerboard 16 and each other to preserve the intonation integrity on a traditional electric or traditional acoustic stringed instrument 12. That is why the elevation tray 28 is needed having this specific inherit ability to insure radial uniformity in the methodology of traditional nut 40 encapsulation for stationary nut elevation.

The elevation tray 28 accurately accommodates both traditional fingerboard 16 and traditional nut 40 radiuses. There are four basic commonly used traditional fingerboard 16 shaped designs (flat, cylindrical, conical and compound) commonly associated with eight different standard radial dimensions in traditional stringed instrument 12 construction. The commonly used eight different standard traditional fingerboard 16 and traditional nut 40 radiuses associated with the four commonly used fingerboard shapes are 7.25, 9.50, 10, 11.25, 12, 16 with the 6 and 20 degree radius fingerboards being less commonly used than the others. A lot of classical guitars are constructed with the flat shaped traditional fingerboard 16 radial design or infinite radius and the vertical instrument string 14 plane must be completely level without any arch and the traditional nut 40 radius must reflect that same flat design. In the flat radial design the traditional nut 40 and saddle and the instrument strings 14 are in one level string plane. The cylindrical radial designed traditional fingerboard 16 is constructed to accommodate a traditional nut 40 and bridge that all have the same nominal radius except the fingerboard is just a little smaller than the traditional nut and bridge. The third shaped is a conical radial designed traditional fingerboard 16 and the traditional nut 40 and the bridge are curved, but the traditional nut radius is smaller than the bridge. The fourth shaped is the compound radius designed traditional fingerboard 16 that has a varying radius where the fingerboard at the traditional nut 40 for example would have a 9.50 degree radius and linearly progresses to a 12 degree radius at the opposite end of the fingerboard with a curved traditional nut and a linear bridge. This explains why it is critical to use the exact traditional nut 40 material and radial specifications for a particular traditional nut and traditional fingerboard 16 combination in order to accommodate the built-in intonation integrity of a particular stringed traditional instrument 12 and that is one more very important reason why the elevation tray 28 is needed to provide controlled elevated radial containment of the traditional nut.

One more important objective of the elevation tray 28 (inserted mechanical tuner) was for the tuner to be commonly used with existing stringed musical instruments 12 and that meant the elevation tray had to fit a variety of existing traditional musical instruments without changing the tuner's overall design structure to accommodate each different radial shaped fingerboard 16. The elevation tray 28 needed to be versatile, because as a general rule of thumb the 7.25 to 10 degree fingerboard radiuses are easier to play chords and rhythm on while the 11.25 to 16 degree radial fingerboards are better for lead soloing. In the final analysis it should be noted that the actual playability of any traditional fingerboard 16 radius is based solely on individual preference. With these objectives in mind the elevation tray 28 had to work in combination with any floating bridge that made use of a compensated saddle assembly where vertical and horizontal instrument string 14 adjustments are sometimes made at the bridge of the instrument 12 and the elevation tray had to work equally as well with the stationary bridge assembly and fixed saddle where adjustments are on occasion made by using a file on the saddle or by inserting a shim to adjust the vertical string heights and horizontal string lengths. The design objectives had to take into consideration that a traditional nut slot 60 already existed between the instrument headstock 24 and the instrument neck 22 on a traditional string musical instrument 12. Furthermore the different nut slots 60 on existing traditional musical instruments 12 had predetermined dimensions designed to encapsulate the traditional nut 40. Several different standard traditional nut 40 dimensions with respect to nut length, width and height have remained a common standard to most all traditional make and modeled stringed musical instruments 12 both vintage and new over the past 50 or more years.

Varying the insert's length, tray channel 38 width, and the insert's channel depth to compensate for any one of the commonly used standard traditional nut 40 dimensions, allows the elevation tray 28 to retain it's appearance and universal structural design, so the insert can be lengthened, narrowed or widen and constructed to fit with precision into any one of a number of standard traditional nut slots 60 existing on both vintage and modern stringed musical instruments 12.

In order to protect the original musical scale length (see FIG. 3A) and (see FIG. 3B), material and radial intonation design of the stringed musical instrument 12 the traditional nut's 40 bottom is sanded in a horizontal manner to compensate for the channel floor 66 and lift plate 42 thickness, (see FIG. 4) then only the insert's channel wall 64 front and back height and thickness is sanded from the traditional nut's front and back sides respectively so the outer vertical wall surface of the (see FIG. 1) tray channel 38 and the outer vertical wall surface of the traditional nut 40 remain in the same smooth vertical surface plane true to the musical scale length on the stringed musical instrument 12 from where the instrument strings 14 contact the nut to where the strings contact the saddle. This preserves the musical scale length of the traditional instrument 12 and allows the traditional nut 40 to fit into the tray channel 38 slot with meticulous precision.

The elevation tray 28 (inserted mechanical tuner) is not an adjustable nut made of metal to support the instrument strings 14 rather a complete and different component designed to work with a traditional or conventional nut 40 made of organic or synthetic material, e.g., plastic, and should not be confused with a nut assembled from metal or any other physical matter.

Musical instrument nuts assembled from any material that support the strings of the instrument such as with metal supports with a physical structural design dimension that changes the musical scale length and the predetermined traditional nut slot 60 standard physical dimension already constructed into the traditional instrument's neck 22 of an existing stringed musical instrument 12 proves impractical for common traditional nut 40 replacement whatever the reason. A neck through, set neck or bolt on existing stringed musical instrument neck 22 with a musical scale length that has already been physically constructed can not be physically altered without adversely affecting the intonation and musical scale length of the musical instrument 12.

This elevation tray 28 prevents time consuming labor and expensive instrument neck 22 modifications to existing vintage and modern stringed musical instruments 12. The elevation tray 28 has a universal design that accommodates existing standard traditional nut 40 and standard fingerboard 16 radiuses, conserves the original material used in the stringed instrument 12 intonation construction, preserves the musical scale length and offers improved ease of use to fit the personal needs of the individual musician. The elevation tray 28 (inserted mechanical tuner) also provides an alternate method of tuning the stringed musical instrument 12 and a novel method of changing the string 14 action (playability) to increase individual finger dexterity and slide proficiency while playing the traditional musical instrument.

The present invention 10 may be summarized as follows: an apparatus and method for adjusting the nut 40 of a stringed instrument 12, comprising, an elevation tray 28 having first and second side portions 34, 36 and a channel portion 63 for receiving the nut 40, wherein each side portion has a cavity 52 therein; a lift plate 42 having first and second end portions disposed in the elevation tray so that the nut rests on the lift plate, each end portion having a threaded hole 72 therein; a cap 54 disposed in each cavity of the elevation tray, the cap having a first aperture 55 therein; a bushing 70 disposed in each cavity of the elevation tray underneath the cap, the bushing having a second aperture 69 therein; a screw 50 having a threaded portion 56 passing through each first and second apertures so that the threaded portion of each screw mates to the threaded hole in each end portion of the lift plate, wherein the screw is removably secured to the cap; and, wherein the lift plate and the nut are moved up or down in response to the cap being turned; furthermore, wherein the bushing has a plurality of spaced apart index marks 76 disposed circumferentially about its lateral surface, wherein the cap has an index pointer 78 extending laterally from its lateral surface so that the index pointer cooperates with the index marks so that the cap can be incrementally turned by a user a user-selected number of degrees by referencing the index pointer to the index marks; and, furthermore, wherein the channel portion 63 is a cross member 42 disposed between the first and second side portions of the elevation tray, wherein each cavity is cylindrically shaped having a central axis, wherein each side portion is defined by a wall 88 having a cut-through portion 90 therein, wherein the channel portion is defined by first and second walls 64, wherein the channel portion of the cross-member is contiguous to the cut-through in the first and second side portions, wherein the nut has first and second ends, wherein the nut is disposed in the channel and the first end of the nut extends into the first cut-through and the second end of the nut extends into the second cut-through.

I claim:

1. An apparatus for adjusting the nut of a stringed instrument, comprising:

a) an elevation tray having first and second side portions and a channel portion for receiving the nut, wherein each said side portion has a cavity therein;

b) a lift plate having first and second end portions disposed in said elevation tray so that the nut rests on said lift plate, each said end portion having a threaded hole therein;

c) a cap disposed in each said cavity of said elevation tray, said cap having a first aperture therein;

d) a bushing disposed in each said cavity of said elevation tray underneath said cap, said bushing having a second aperture therein;

e) a screw having a threaded portion passing through each said first and second apertures so that said threaded portion of each said screw mates to said threaded hole in each said end portion of said lift plate, wherein said screw is removably secured to said cap; and, f) wherein said lift plate and the nut are moved up or down in response to said cap being turned.

2. The apparatus of claim 1, wherein said bushing has a plurality of spaced apart index marks disposed circumferentially about its lateral surface, wherein said cap has an index pointer extending laterally from its lateral surface so that said index pointer cooperates with said index marks so that said cap can be incrementally turned by a user a user-selected number of degrees by referencing said index pointer to said index marks.

3. The apparatus of claim 1, wherein each said bushing is press fit into each said cavity so as to removably attach each said bushing to said elevation tray.

4. The apparatus of claim 1, further comprising a set screw for securing said screw to said cap.

5. The apparatus of claim 1, wherein said lift plate is a single piece.

6. The apparatus of claim 1, wherein said lift plate comprises two pieces.

7. The apparatus of claim 1, wherein said channel portion is a cross member disposed between said first and second side portions of said elevation tray, wherein each said cavity is cylindrically shaped having a central axis, wherein each said side portion is defined by a wall having a cut-through portion therein, wherein said channel portion is defined by first and second walls, wherein said channel portion of said cross-member is contiguous to said cut-through in said first and second side portions, wherein the nut has first and second ends, wherein the nut is disposed in said channel and the first end of the nut extends into said first cut-through and the second end of the nut extends into said second cut-through.

8. A method for adjusting the nut of a stringed instrument, comprising the steps of:

a) providing an elevation tray having first and second side portions and a channel portion for receiving the nut therein, wherein each side portion of the elevation has a cavity thereon;

b) providing a lift plate having first and second end portions disposed in the elevation tray so that the nut rests on the lift plate, each end portion having a threaded hole therein;

c) providing a cap in each cavity of the elevation tray, the cap having a first aperture therein;

d) providing a bushing in each cavity of the elevation tray underneath the cap, the bushing having a second aperture therein;

e) providing a screw having a threaded portion passing through the first and second apertures so that the threaded portion of the screw mates to the threaded hole in each end portion of the lift plate, wherein the screw is removably secured to the cap; and, f) turning the cap to move the lift plate and the nut up or down.

9. The method of claim 8, wherein the bushing has a plurality of evenly spaced apart index marks disposed circumferentially about its lateral surface so that the index marks are disposed at varying degrees about the bushing, wherein the cap has an index pointer extending laterally from its lateral surface so that the index pointer cooperates with the index marks so that the cap can be incrementally turned by a user a user-selected number of degrees by referencing the index pointer to the index marks.

10. The method of claim 8, wherein each bushing is press fit into each cavity so as to removably attach the bushing to the elevation tray.

11. The method of claim 8, further comprising the step of providing a set screw for securing the screw to the cap.

12. The method of claim 8, wherein the lift plate is a single piece.

13. The method of claim 8, wherein the lift plate consists of two pieces.

14. The method of claim 8, further comprising the step of adjusting the string action of a stringed instrument.

15. The method of claim 8, further comprising the step of adjusting the string tuning of a stringed instrument.

16. The method of claim 8, further comprising the step of providing a centrally disposed elevation tray relative to the fingerboard of the stringed instrument at all times.

* * * * *